US006079712A

United States Patent [19]

Eaton et al.

[11] Patent Number: 6,079,712

[45] Date of Patent: Jun. 27, 2000

[54] WAGERING GAME AND TABLE LAYOUT FOR PLAYING SAME

[75] Inventors: Christopher M. Eaton; Timothy E. Eaton, both of Independence; Jeffery D. Hohman, Lee's Summit, all of Mo.

[73] Assignee: Pick One, Inc., Independence, Mo.

[21] Appl. No.: 09/170,515

[22] Filed: Oct. 13, 1998

[51] Int. Cl.[7] ..... A63F 1/00

[52] U.S. Cl. ..... 273/274; 273/292

[58] Field of Search ..... 273/274, 292, 273/309

[56] References Cited

U.S. PATENT DOCUMENTS

| | | |
|---|---|---|
| 3,667,757 | 6/1972 | Holmberg . |
| 4,875,164 | 10/1989 | Monfort . |
| 5,154,429 | 10/1992 | LeVasseur . |
| 5,174,579 | 12/1992 | Griffiths . |
| 5,257,810 | 11/1993 | Schorr et al. ..... 273/292 |
| 5,275,416 | 1/1994 | Schoor et al. . |
| 5,556,101 | 9/1996 | Jabro . |
| 5,615,888 | 4/1997 | Lofink et al. . |
| 5,649,705 | 7/1997 | String . |
| 5,669,606 | 9/1997 | Brown . |
| 5,685,774 | 11/1997 | Webb . |
| 5,707,287 | 1/1998 | McCrea . |
| 5,758,878 | 6/1998 | Brown . |
| 5,762,340 | 6/1998 | Feola . |
| 5,772,211 | 6/1998 | Nazaryan et al. . |
| 5,775,696 | 7/1998 | Sidlow et al. . |
| 5,813,673 | 9/1998 | Richardson . |
| 5,876,283 | 3/1999 | Parra et al. . |

OTHER PUBLICATIONS

Station Casino Kansas City Hotel and Casino Gaming Guide (1996).

*Primary Examiner*—William M. Pierce

*Attorney, Agent, or Firm*—Hovey, Williams, Timmons & Collins

[57] ABSTRACT

A method of playing a wagering game with a deck of numerically valued cards includes the steps of having each player make an initial wager and dealing at least two cards to form a corresponding number of hands. Each player is asked to select an initial winning option based on how the player expects the hands to be dealt. The game further involves dealing an additional card to each of the hands until each of the hands has a count of at least a first predetermined value, such as seventeen in the case of blackjack, and then awarding each of the players whose initial winning option correctly predicted how the hands would be dealt. The game method may also include the step of accepting a second wager from each of the players, simultaneously having each player who made the second wager select a second winning option based on how that player expects the hands to be dealt, and awarding the players whose second winning option correctly predicted how the hands would be dealt. The present invention also concerns a table layout for playing the above-noted wagering game.

18 Claims, 2 Drawing Sheets

WAGERING GAME AND TABLE LAYOUT FOR PLAYING SAME

BACKGROUND OF THE INVENTION

1. Field of the Invention

The present invention relates generally to wagering games, such as those played in casinos. More particularly, the present invention concerns a card game in which two hands of cards are played against one another by the dealer and the players bet on the expected outcome of cards being dealt to and of the hands according to a set of rules. The present invention also concerns a table layout for playing such a card game.

2. Discussion of Prior Art

One of the most popular wagering games is blackjack (alternatively referred to as twenty-one). Generally speaking, each player competes against the dealer or "the house" with the objective of being dealt a hand having a count higher than the dealer's hand without exceeding a count of twenty-one. However, there are several problems associated with conventional blackjack.

For example, players must have some degree of skill when playing blackjack; otherwise, the player will quickly lose money and consequently interest in the game. Not only is it necessary for a player to know the basic rules and objectives of blackjack, the odds of winning can be significantly improved if a player is knowledgeable of the general guidelines for being hit (i.e., for taking additional cards from the dealer) depending on his/her hand and the dealer's exposed card. It is also believed that this acquired skill is particularly critical for the player dealt cards last (i.e., the player sitting immediately to the dealer's right). Specifically, some believe that this player can alter the chances of the entire table by affecting the cards dealt to the dealer's hand. For example, if the last player takes an unnecessary hit card in contradiction to the guidelines, this card would naturally have been dealt to the dealer's hand, if necessary, and could possibly have caused the dealer to bust. Another problem with conventional blackjack is that players are typically required to make their initial bet before any cards are dealt. Players will often consequently feel as though they are making a blind wager without any indication as to how the cards may be dealt. Yet another problem often associated with conventional blackjack is the potential for slow paced games as a result of players taking time to decide on whether to hit or stay It is also be believed that conventional blackjack is problematic because players compete individually against the dealer, which will often cause players to look elsewhere for the comradery provided by other wagering games (e.g., craps). Those ordinarily skilled in the art will appreciate that all of these problems have the potential to adversely affect earnings by the house.

OBJECTS AND SUMMARY OF THE INVENTION

Responsive to these and other problems, an important object of the present invention is to provide a wagering game that is interesting, captivating and fast paced. It is also an important object of the present invention to provide a wagering game that does not require a high level of skill. Another important object of the present invention is to provide a wagering game that is useful in educating players about the game of blackjack. Yet another important object of the present invention is to provide a wagering game that enhances comradery among the players. In particular, an important object of the present invention is to provide a wagering game that pits at least two dealer hands against one another which is naturally more exciting for the players and is likely to generate comradery as players make similar wagers as to how they expect the hands to be dealt. Furthermore, an important object of the present invention is to provide a wagering game that gives the players the perception that they determine the odds of winning, or at the very least they have the ability to affect those odds, rather than relying purely on statistical chance. An additional important object of the present invention is to provide a table layout for use in playing a wagering game that provides the previously noted objects.

In accordance with these and other objects evident from the following description of the preferred embodiment, the present invention concerns a method of playing a wagering game with a deck of numerically valued cards including the steps of having each player make an initial wager and dealing at least two cards to form a corresponding number of hands. Each player is asked to select an initial winning option based on how the player expects the hands to be dealt. The game further involves dealing an additional card to each of the hands until each of the hands has a count of at least a first predetermined value, such as seventeen in the case of blackjack, and then awarding each of the players whose initial winning option correctly predicted how the hands would be dealt.

If desired, the game may also include the step of accepting a second wager from each of the players, and simultaneously having each player who made the second wager select a second winning option based on how that player expects the hands to be dealt. Similar to the initial wager and initial winning option, players are awarded when their second winning option correctly predicted how the hands would be dealt.

The present invention also concerns a table layout for playing the above-noted wagering game. The table layout includes a dealer station having at least two spaced apart dealer hand locations to which cards are dealt. In addition, a plurality of player stations are provided, with each player station including an initial wager location and a set of initial winning option locations having indicia thereon corresponding to different ways the hands may be dealt. If the players are given an opportunity to place a second wager, each player station also includes a set of second winning option locations having indicia thereon corresponding to different ways the hands may be dealt.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a flow diagram illustrating the steps of playing a wagering game in accordance with the principles of the present invention; and FIG. 2 is a plan view of a table layout useable in playing a wagering game in accordance with the principles of the present invention.

DETAILED DESCRIPTION OF THE PREFERRED EMBODIMENT

Figure 1:
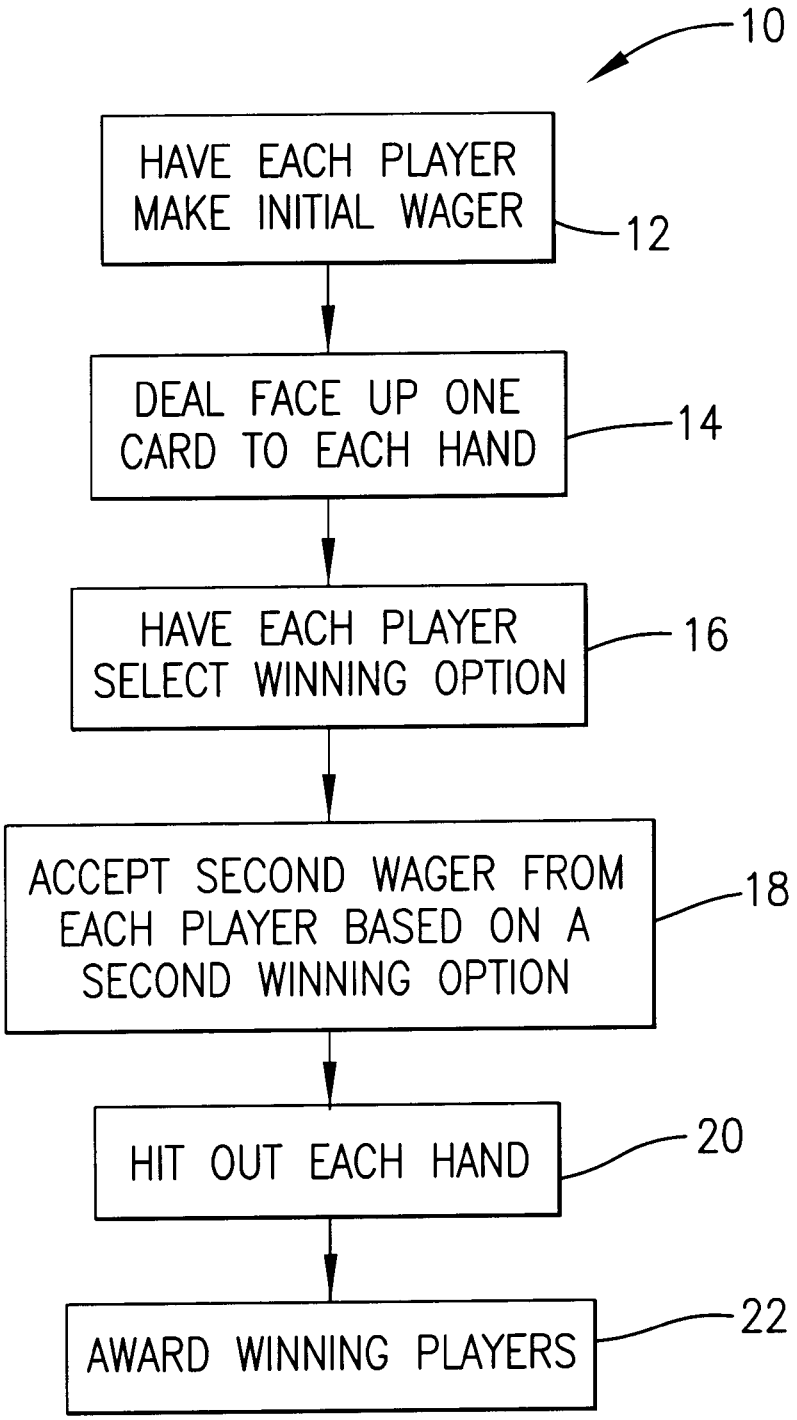

Turning initially to FIG. 1, the wagering game method selected for illustration comprises a series of steps, generally referenced by the numeral 10, that are preferably performed in sequence, although the sequence may be varied to some degree as will subsequently be described. Generally speaking, the illustrated method 10 includes step 12 of having each player make an initial wager, step 14 of dealing face up one card to each hand, step 16 of having each player select a winning option, step 18 of accepting a second wager from each player based on a second winning option, step 20 of hitting out each hand, and step 22 of awarding the winning players.

Figure 2:
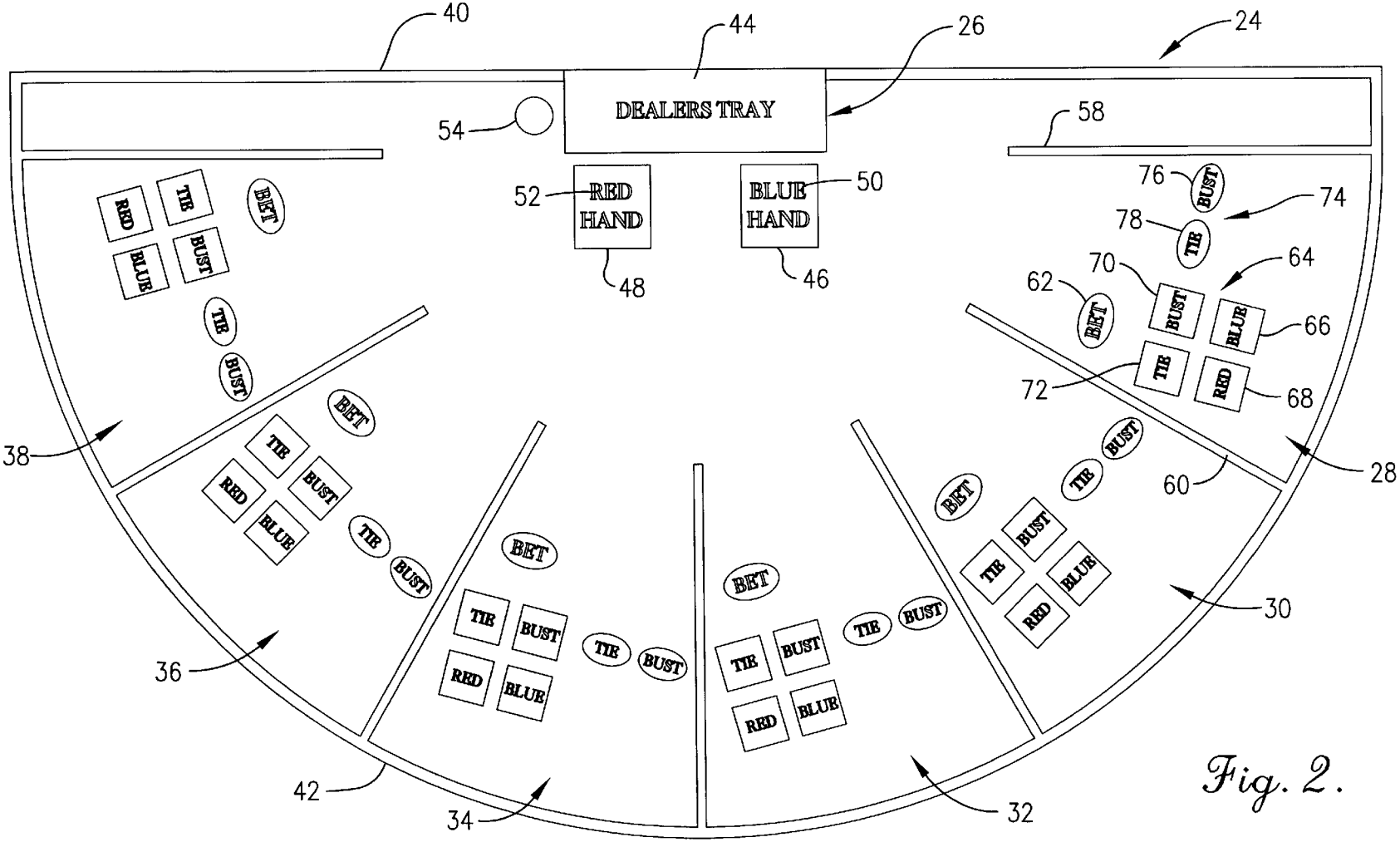

The wagering game method 10 is suitable for playing at a casino table wherein a dealer controls playing of the game and players sit around the table and participate in the game as directed by the dealer. A preferred table layout 24 (see FIG. 2) for use in playing the game method 10 is described further hereinbelow. However, those ordinarily skilled in the art will appreciate that the illustrated method 10 may also be played at an individual player station (not shown) having a visual display and being controlled by a suitable electronic controller, such as a microprocessor (also not shown). The individual player station may be operably coupled to the electronic controller via any suitable connection, such as the Internet, a local area network, etc.

Turning to step 12, the dealer first preferably has each player make an initial wager, although the wager may be made after step 14 (e.g., simultaneous with step 16), if desired. In the usual manner, the dealer may place a limit or cap on the initial wager and persons sitting at the table are not required to play every hand. However, for purposes of this description, it will be assumed that those persons not making an initial wager are not considered a player with respect to the remaining steps of the method 10. As with most conventional casino table games, step 10 preferably involves having each of the players place the initial wager (e.g., in the form of cash, chips, etc.) in a specific location on the table 24, as will subsequently be described.

In the illustrated method 10, once the initial wager has been made, the dealer performs step 14 by dealing face up at least two cards to form a corresponding number of hands. In other words, step 14 involves dealing one card to each of the hands. Preferably, only two cards are dealt by the dealer during step 14 so that two hands are formed. We believe that having only two hands is naturally more adversarial than three or more hands, and that the game is consequently more exciting. It is noted that the cards need not be dealt face up, however, the cards are preferably exposed to the players before step 16 is performed. As will be described further hereinbelow, the cards are preferably dealt to spaced apart, distinctively marked locations, which makes it easier to distinguish the two hands from one another.

Preferably, the cards are dealt from a standard card deck, although more than one deck may be combined in the usual manner. It is also possible to use a unconventional card deck, however, each of the cards must have a numerical value.

Step 16 involves having each player select a winning option based on how he/she expects the hands to be dealt. Step 16 preferably follows step 14 so that each player selects the winning option after viewing at least part of each hand (i.e., the first card of each hand has been dealt face up during step 14). However, the principles of the present invention are equally applicable to a game method in which steps 12 and 16 are performed before step 14, whereby the players are required to make their initial wager and select the initial winning option before having an opportunity view any of the cards. It is also within the ambit of the present invention to perform both steps 12 and 16 after step 14, as noted above, although this sequence will likely lower the "take" (i.e., earnings) of the house sufficiently to make it impractical in true casino situations. In either alternative, the steps 12 and 16 may be performed concurrently, for example, by having each player place the initial wager in one of several different locations on the table, each of which corresponds with one of the winning options. Returning to the illustrated method 10, with step 16 following step 14, the players are given the perception and, in some cases (assuming the players know the odds based on which cards have been dealt during step 14), the ability to improve their chances of winning.

As will also be indicated below with respect to step 20, the hands are dealt with the objective of each hand having the highest possible count between a first predetermined value and a relatively greater second predetermined value, inclusive. Those ordinarily skilled in the art will appreciate that this objective is similar to that utilized when dealing the dealer's hand in the game of blackjack (i.e., to have the highest possible count above sixteen without exceeding twenty-one). That is to say, the dealer must deal his/her hand until it has a count of at least seventeen, with the aim of totaling twenty-one but not exceeding twenty-one. In this respect, the preferred method 10 involves playing two blackjack dealer's hands against one another using at least one standard deck of cards. In the usual manner, the numbered cards have a value equal to their number, the face cards (jacks, queens and kings) have a value of ten, and the aces have a value of eleven, when dealt as the first card to either hand during step 14, or a value of one or eleven, when dealt as a "hit" card to either hand during step 20. The unique valuation of the aces is preferred because we have determined that the "take" of the house is slightly improved when aces dealt during step 14 are assigned only a value of eleven. However, it is entirely within the ambit of the present invention to always assign the aces the alternative valuation of one or eleven. It is also noted that the present invention is not limited to dealing blackjack hands against one another, but rather contemplates the use of any set of numerically valued cards dealt into at least two hands, with the above-noted objective For example, it is entirely within the ambit of the present invention to utilize an unconventional deck of numerically valued cards, wherein the first and second predetermined values are arbitrarily selected or changed before each game is started.

In any case, step 16 preferably involves having each player select an initial winning option from a group consisting of one hand beating the other hand, both hands tying without exceeding the second predetermined value, and both hands exceeding the second predetermined value. With respect to the first option, one of the hands beats the other when both hands are between the first and second values, inclusive, and the one hand has a count greater than the count of the other hand, or when one of the hands is between the first and second values, inclusive, and the other hand exceeds the second value. If there are more than two hands being dealt, the players may be given the option to select more than one winning hand. A tie situation occurs when both hands have a coequal count that is between the first and second predetermined values, inclusive. The third option, which will be referred to as a bust situation, occurs when both hands exceed the second predetermined value. Obviously, in the preferred method 10 in which two blackjack hands are played against one another, the first and second predetermined values are seventeen and twenty-one, respectively.

Step 16 preferably involves having each player select the winning option by pushing an illuminable switch, as will subsequently be described. Alternatively, step 16 may involve having each player place a marker (e.g., a chip) in one of several winning option locations, each having a distinguishing characteristic that identifies the selected winning option (e.g., indicia representing a tie situation), or having each player place the initial wager in one of the distinctive locations, as noted above. It is also entirely within the ambit of the present invention to offer less, more or different options than those noted hereinabove.

Before additional cards are dealt to each of the hands during step 20, the illustrated method 10 includes the step 18 of accepting a second wager from each player and simultaneously having each player who made a second wager select a second winning option (i.e., players are preferably not required to make a second wager). Although step 18 is not necessary, it is preferred because this step permits the players to make a wager after having an opportunity to see at least part of each hand (i.e., the first card of each hand has been dealt face up during step 14). Those ordinarily skilled in the art will appreciate that such a sequence is likely to improve player interest, enthusiasm, and excitement. To ensure that the method 10 is still "profitable" for the house, the second wager is preferably limited to an amount not to exceed the first wager, although the second wager may be limited to some multiplier of the first wager, if desired. In the illustrated method 10, it is also preferred that the second winning option be selected from a group consisting of both hands tying and both hands exceeding the second predetermined value (e.g., twenty-one). Similar to the first winning option, the group of winning options available to the players may be varied, if desired. For example, the tie and bust options may be combined. In addition, if the game involves more than two opposing hands, the players may be given the opportunity to also select an additional winning hand during step 18.

It is noted that the term "simultaneously" as used herein shall be interpreted to mean not only concurrently (i.e., at the same time), but also within the same general time frame before a subsequent step in the game method 10 takes place. Thus, step 18 may be performed by having each player who makes a second wager place that wager in a location spaced from the first wager location, and then having the player select a second winning option in a manner similar to the selection of the first winning option. However, step 18 preferably involves accepting a second wager from each player and concurrently having each player select the second winning option. This may be accomplished, for example, by having each player who makes a second wager place the wager in one of two locations, each having indicia to represent a tie situation or a bust situation, as will subsequently be described. It is noted that players are preferably limited to selecting one initial winning option during step 16 and one second winning option during step 18.

As previously indicated, step 20 involves dealing to each hand an additional card until each of the hands has a count equal to or greater than the first predetermined value. Because the illustrated method 10 involves playing two blackjack dealer hands against one another, each of the hands are hit out until each has a count of at least seventeen. Moreover, once each hand has a count of at least seventeen, no additional cards are dealt to that hand. In other words, each hand will stand once it has a count equal to or greater than seventeen. Each hand also preferably stands on a so-called "soft" count of seventeen or higher (a hand including at least one ace that has been dealt during step 20 so as to have a value of one or eleven, with the hand having a count of at least seventeen and being unable to be dealt a card having a value of ten without exceeding a count of twenty-one). It is also preferred that the hands be sequentially hit out, with cards being dealt face up to one of the hands until that hand has a count of at least seventeen, and then hitting out the remaining hand in the same manner.

Once the hands have been hit out, the players whose initial or second winning option correctly predicted how the hands would be dealt are awarded. When one hand beats the other and the player correctly selected the option of that hand beating the other, the player is preferably paid an amount equal to his/her wager. As noted above, this winning option is available to the players only during step 16 in the illustrated method 10, and accordingly, any payout based on this option is equal to the player's initial wager. It is also been determined that to improve the "take" of the house, a commission may be charged to a player who correctly selects one hand over another when an ace was the first card dealt to that one hand during step 14. One suitable commission is five percent of the initial wager. Alternatively, if both hands tie without exceeding the second predetermined value, each player who correctly selected the tie option is preferably paid an amount equal to four times his/her wager based on that winning option. Obviously, because the players are given an opportunity to select the tie option during both steps 16 and 18, players have an opportunity to receive this payout based on both their initial and second wagers. Finally, when both hands exceed the second predetermined value, each player who correctly selected the bust option is preferably paid an amount equal to four times his/her wager based on that option. Similar to the tie option, players are twice given an opportunity to select the bust option (i.e., during both steps 16 and 18) and therefore may receive a payout for the initial wager and a payout for the second wager, when the bust option is correctly selected during steps 16 and 18. Those ordinarily skilled in the art will appreciate that these awards may be varied by the house to adjust earnings from the game method 10.

Typically, the payouts are made from the dealer's right to left. At the same time, losing bets are collected in the same order, and cards are then retrieved by the dealer in a manner that permits reconstruction of the hands, if necessary.

Turning now to the illustrated table layout 24 for use in playing the game method 10, the layout 24 generally includes a dealer station 26 and six player stations 28,30, 32,34,36,38. The layout 24 is generally in the shape of a half circle, with the dealer station 26 being located centrally along the flat edge 40 of the layout 24 and the player stations 28–38 being spaced about the arcuate edge 42. However, the principles of the present invention are equally applicable to various other layout shapes (e.g., rectangular layouts). It is also entirely within the ambit of the present invention to provide more or less player stations than the number illustrated.

The dealer station 26 is provided with a tray 44 designed to hold chips (not shown) which are stored during each game. In the usual manner, the tray is usually open and includes several semicircular grooves for containing rows of chips. The dealer station further includes two spaced apart dealer hand locations 46 and 48. The preferred dealer hand locations 46 and 48 are defined by a rectangular-shaped border and have distinguishing indicia 50 and 52 thereon to distinguish the hand locations 46 and 48 from one another. In the illustrated embodiment, the distinguishing indicia 50 and 52 comprises respective wording "BLUE HAND" and "RED HAND", with the indicia 50 preferably being colored blue and the indicia 52 preferably being colored red. However, it is entirely within the ambit of the present invention to utilize various other distinguishing indicia (e.g., different symbols, characters, numbers, letters, etc.). Furthermore, additional dealer hand locations may be included on the layout 24, if the game method involves dealing more than two hands. It will be appreciated that the dealer hand locations 46 and 48 are designed so that each hand is contained within the boundaries, however, one or more cards may be placed slightly outside the boundary when a large number of cards are dealt to a hand before the first predetermined value is reached. The dealer station 26 further includes a "lock-out" switch 54, for purposes which will subsequently be described.

It is noted that each of the player stations 28–38 is nearly identical in construction. Thus, for the sake of brevity, only one of the players stations will be detailedly described herein, with the understanding that the remaining player stations are similarly constructed. Turning to the leftmost player station 28 (as viewed from the dealer station 26), a pair of spaced apart boundary lines 58 and 60 extend generally radially inwardly from the arcuate edge 42 to separate the players stations from one another. It is noted that adjacent player stations (e.g., player stations 28 and 30) share an adjacent boundary line (e.g., line 60).

In particular, the player station 28 includes an initial wager location 62 that is spaced closer to the boundary line 60 than the boundary line 58. The illustrated initial wager location 62 is defined by an oval-shaped boundary and has indicia thereon, in the form of the text "BET", to denote that the initial wager is placed at this location. The player station 28 further includes a set of initial winning option locations, generally referenced by the numeral 64, which have indicia thereon corresponding to different ways the hands may be dealt. Similar to the initial wager location 62, the initial option locations 64 are located nearer the boundary line 60 than the line 58. However, the initial option locations 64 are spaced closer to the arcuate edge 42 than the initial wager location 62 so that the player does not reach over the initial wager to select his/her initial winning option.

Each of the initial winning option locations preferably comprise a depressible, illuminable switch. In the illustrated embodiment, the dealer has each player make his/her initial winning option selection by pushing a switch which is illuminated when depressed. Preferably, the switches are wired in such a manner that only one switch may be illuminated at a time and a selection may be canceled by depressing an illuminated switch a second time. The switches are also coupled to the lock-out switch 54 of the dealer station 26 so that the dealer may lock out the players' ability to change their selections. In this respect, cancellation of a selection may only be made until the dealer depresses lock-out switch 54. As noted above, the initial winning option locations need not comprise illuminable switches, but rather may comprise only demarcated locations which are selected by placing the initial wager or a chip on the desired location.

In correspondence with the method 10 described hereinabove, the winning option locations include a pair of spaced apart winning hand locations 66 and 68 that are defined by generally square-shaped boundaries. The winning hand locations 66 and 68 have distinguishing indicia thereon that is similar to the distinguishing indicia 50 and 52 on the dealer hand locations, so as to facilitate player association with the two different dealer hands. In this respect, the illustrated winning hand locations 66 and 68 include respective wording "BLUE" and "RED", with the text being in the noted color. If the dealer station includes more than two dealer hand locations, as previously indicated, the initial winning option locations include the same number of winning hand locations having similar distinguishing indicia thereon.

The initial winning option locations 64 further include a first bust location 70 defined by a square-shaped boundary and having indicia thereon, in the form of the wording "BUST", to represent a bust situation. In addition, a first tie location 72 is provided, wherein the location 72 is similarly defined by a square-shaped boundary and has indicia thereon, in the form of the wording "TIE", to represent a tie situation.

The player station 28 further includes a set of spaced apart second winning option locations, generally referenced by the numeral 74, which have indicia thereon corresponding to the different ways the dealer hands may be dealt. It is noted that the second winning option locations 74 are located closer to the boundary line 58 than the line 60 and in general alignment with the first tie and bust locations 70 and 72. This again prevents the players from reaching over the initial wager location 62 to select the second winning option. Contrary to the initial winning option locations 64, the illustrated second winning option locations 74 are not in the form of a depressible, illuminable switch, but rather are only demarcated on the layout 24. In this respect, the dealer has each player who makes a second wager concurrently select the second winning option by placing the second wager on the desired location. In addition, the second winning option locations 74 include a second bust location 76 and a second tie location 78. The second bust and tie locations 76 and 78 include indicia similar to the first bust and tie locations 70 and 72, however, the second bust and tie locations 76 and 78 are defined by oval-shaped boundaries. As indicated above with respect to step 18, the second winning option locations may be varied, if desired. For example, if the dealer station 26 includes more than two dealer hand locations, then the second winning option locations 74 may include winning hand locations similar to the initial winning option locations 64. Generally speaking, the sets of initial and second winning option locations 64 and 74 may be varied to correspond with the various alternatives previously noted in the description of the game method 10.

The use of the game method 10 and table layout 24 should be apparent from the foregoing description. Therefore, it shall be sufficient to explain that the dealer preferably has each player make an initial wager by placing a bet within the initial wager location 62. In the illustrated embodiment, the dealer subsequently deals one card face up to the dealer hand locations 46 and 48. Players are then requested to select an initial winning option by depressing one of the winning option locations 64. At this time, a second wager is accepted from each of the players, with those players making a second wager concurrently selecting a second winning option by placing the second wager in one of the second winning option locations 76 or 78. The dealer then locks out the players' ability to change their initial winning option selections by depressing the lock-out switch 54, and the hands are hit out in the manner previously described (see description of step 20). Each of the players whose initial and/or second winning option correctly predicted how the hands would be dealt are awarded, as noted above in the description of step 22. Typically, the dealer collects the losing bets and then retrieves the cards in a manner that permits the hands to be reconstructed, if necessary. The lock-out switch 54 is preferably coupled with the switches at the players stations to clear all selections before the method is repeated. If desired, a separate clear switch (not shown) may be provided at the dealer station to perform this function.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of playing a wagering game with a deck of cards, wherein each card has a numerical value, said method comprising the steps of:

(a) having each player make an initial wager;

(b) dealing face up at least two cards to form a corresponding number of dealer hands;

(c) after step (b), having each player select an initial winning option based on how the player expects the hands to be dealt;

(d) dealing an additional card to each of the hands until each of the hands has a count based on the numerical value of the cards of at least a first predetermined value; and (e) awarding each of the players whose initial winning option correctly predicted how the hands would be dealt.

2. A method of playing a wagering game as claimed in claim 1; and (f) prior to step (d), accepting a second wager from each of the players, and simultaneously having each player who made the second wager select a second winning option based on how that player expects the hands to be dealt, step (e) including the step of awarding each of the players whose second winning option correctly predicted how the hands would be dealt.

3. A method of playing a wagering game as claimed in claim 2, step (f) including the step of limiting the second wager to an amount not to exceed the initial wager.

4. A method of playing a wagering game as claimed in claim 1, step (c) including the step of having each player select the initial winning option from a group consisting of hands exceeding a second predetermined value that is greater than the first predetermined value, one hand having an aggregate value greater than the at least one other hand, with the aggregate value not exceeding the second predetermined value, and all hands having a coequal count, without exceeding the second predetermined value.

5. A method of playing a wagering game as claimed in claim 4; and (f) prior to step (d), accepting a second wager from each of the players, and simultaneously having each player who made a second wager select a second winning option based on how that player expects the hands to be dealt, step (e) including the step of awarding each of the players whose second winning option correctly predicted how the hands would be dealt.

6. A method of playing a wagering game as claimed in claim 5, step (f) including the step of having each player who makes the second wager select the second winning option from a group consisting of hands exceeding the second predetermined value, and all hands having a coequal count, without exceeding the second predetermined value.

7. A method of playing a wagering game as claimed in claim 6, step (e) including the step of paying each player to be awarded a payment selected from a group consisting of amount equal to the wager when the player correctly selected the option of one hand having an aggregate value greater than the at least one other hand, with the aggregate value not exceeding the second predetermined value, an amount equal to four times the wager when the player correctly selected the option of all hands exceeding the second predetermined value, and an amount equal to four times the wager when the player correctly selected the option of all hands having a coequal count, without exceeding the second predetermined value.

8. A method of playing a wagering game as claimed in claim 1, step (a) including the step of having each player place the initial wager in an initial wager location.

9. A method of playing a wagering game as claimed in claim 1, step (c) including the step of having each player push a button to select the initial winning option.

10. A method of playing a wagering game with at least one standard deck of cards, said method comprising the steps of:

(a) having each player make an initial wager;

(b) dealing face up two cards to form two blackjack hands;

(c) after step (b) having each player select an initial winning option based on how the player expects the hands to be dealt;

(d) accepting a second wager from each of the players, and simultaneously having each player who makes the second wager select a second winning option based on how that player expects the hands to be dealt;

(e) dealing face up an additional card to each of the hands until each of the hands has a count based on the numerical value of the cards of at least seventeen; and (f) awarding each of the players whose initial or second winning option correctly predicted how the hands would be dealt.

11. A method of playing a wagering game as claimed in claim 10, step (c) including the step of having each player select the initial winning option from a group consisting of one hand beating the other hand, both hands tying, and both hands busting.

12. A method of playing a wagering game as claimed in claim 11, step (d) including the step of having each player who makes the second wager select the second winning option from a group consisting of both hands tying and both hands busting.

13. A method of playing a wagering game as claimed in claim 12, step (f) including the step of paying each player to be awarded a payment selected from a group consisting of amount equal to the wager when the player correctly selected the option of one hand beating the other hand, an amount equal to four times the wager when the player correctly selected the option of both hands tying, and an amount equal to four times the wager when the player correctly selected the option of both hands busting.

14. A method of playing a wagering game as claimed in claim 12, step (d) including the step of having each player who makes the second wager place the second wager in a tie wager location or a bust wager location to concurrently indicate the selected winning option.

15. A method of playing a wagering game as claimed in claim 10, step (d) including the step of limiting the second wager to an amount not to exceed the initial wager.

16. A method of playing a wagering game as claimed in claim 10, step (a) including the step of having each player place the initial wager in an initial wager location.

17. A method of playing a wagering game as claimed in claim 10, step (c) including the step of having each player push a button to select the initial winning option.

18. A method of playing a wagering game with a deck of cards, wherein each card has a numerical value, said method comprising the steps of:

(a) having each player make an initial wager;

(b) dealing at least two cards to form a corresponding number of dealer hands;

(c) having each player select an initial winning option based on how the player expects the hands to be dealt;

(d) dealing, without player involvement and without regard to the initial winning option selected by each player, an additional card to each of the hands until each of the hands has a count based on the numerical value of the cards of at least a first predetermined value; and (e) awarding each of the players whose initial winning option correctly predicted how the hands would be dealt.

* * * * *